US005746377A

United States Patent [19]

Gehrig

[11] Patent Number: 5,746,377

[45] Date of Patent: May 5, 1998

[54] APPARATUS FOR COMMINUTING WASTE MATERIALS

[75] Inventor: Johann Gehrig, Kleinwallstadt, Germany

[73] Assignee: Colortronic GmbH, Friedrichsdorf, Germany

[21] Appl. No.: 531,167

[22] Filed: Sep. 19, 1995

[30] Foreign Application Priority Data

Sep. 20, 1994 [DE] Germany ..... 44 33 473.7

[51] Int. Cl.[6] ..... B02C 18/16

[52] U.S. Cl. ..... 241/73; 241/242; 241/285.3

[58] Field of Search ..... 241/285.1, 285.2, 241/285.3, 242, 243, 73

[56] References Cited

U.S. PATENT DOCUMENTS 2,756,002 7/1956 Brake ..... 241/285.3

4,000,860 1/1977 Gotham ..... 241/285.3 X

FOREIGN PATENT DOCUMENTS 2632330 4/1983 Germany .

*Primary Examiner*—Mark Rosenbaum

*Attorney, Agent, or Firm*—W. G. Fasse; W. F. Fasse

[57] ABSTRACT

The housing of a waste cutter is divided in a central, vertical plane so that each housing section (23, 24) is tiltable about a respective hinge (26, 27) each preferably having a vertically extending hinging axis (26B, 27B) positioned at a rear bearing shield (10) in which a rear end of a cutting rotor (1) is rotatably mounted. The front end of the cutting rotor (1) is rotatably mounted in a front bearing shield (14). A clamping and locking device (33) pulls the housing sections (23, 24) into a closed position and holds the sections in the closed position. By opening the housing sections the entire interior is easily accessible for maintenance and cleaning work.

17 Claims, 4 Drawing Sheets

APPARATUS FOR COMMINUTING WASTE MATERIALS

FIELD OF THE INVENTION

The invention relates to an apparatus for comminuting waste materials, especially of synthetic materials that become waste in connection with injection molding such materials, whereby stalks or dead-heads need to be recovered and comminuted for a new use.

BACKGROUND INFORMATION

Comminuting mills for the above purpose comprise conventionally a rotor carrying at least one rotor knife. The rotor normally has a horizontal axis and is mounted for rotation in a housing which also encloses a stator knife or counter edge for cooperation with the rotor knife. The housing may be divided along a central horizontal plane into a stationary housing section and a movable housing section, whereby the latter is tiltable about a tilting axis for movement between an opened position and a closed position. A clamp ties the two housing sections to each other in the closed position.

German Patent Publication DE 2,632,330 C2 discloses a comminuting mill of the type described above. The known housing is divided horizontally into a tiltable upper housing section carrying a stator knife and a stationary lower housing section carrying a screen or sieve having a semi-cylindrical shape and extending concentrically to the rotational axis of a rotor mounted in the housing. The upper housing section can be tilted upwardly about a tilting or journal axis extending in parallel to the rotor axis. The lower housing section is not tiltable and carries clamps on both sides of the rotor axis. Thus, it is possible to clamp the two housing sections to each other in the closed operational position on both sides, namely on the side where the journal axis for the upper housing section is located, and on the diametrically opposite side to keep the housing closed during operation.

The construction according to German Patent Publication DE 2,632,330 C2 provides access to the interior of the cutting mill by tilting the upper housing section upwardly about the horizontal hinging axis. The construction is such that the rotor may be selectively connected or disconnected from the upper housing section so that it is possible to either tilt the upper housing section alone out of the way or to tilt it together with the rotor out of the way. The stator knives become accessible by only tilting the upper housing section out of the way. The screen or sieve below the rotor becomes accessible when the rotor and the upper housing section are tilted out of the way.

The just described conventional construction provides relatively good access for maintenance and cleaning operations. However there is room for improvement because the accessibility is one-sided, namely primarily on the side opposite to the tilting axis. Further, the stator knife and the sieve or screen are not simultaneously accessible. Rather, certain disassembly steps must be taken to make these components accessible.

Comminuting mills as described above must be frequently cleaned, especially when these mills are used in connection with injection molding operations which generate synthetic or plastic waste materials that must be comminuted for further processing. The cleaning of the cutting mill becomes necessary, for example between batches of materials that have different colors. In such situations the mill must be cleaned after each batch is completed. Thus, it is desirable that the cleaning operation can be performed as simply and as quickly as possible. In order to satisfy this requirement it is essential that opening the housing provides an immediate accessibility to all components and areas of the mill to be cleaned, inspected and, if needed, repaired. Such accessibility facilitates maintenance operations.

OBJECTS OF THE INVENTION

In view of the above it is the aim of the invention to achieve the following objects singly or in combination:

- to construct the cutter or mill housing in such a way that all components and areas of the interior of the mill are more easily and more quickly accessible than is possible in the prior art;
- to construct and mount the screen in such a way that it can be removed from the mill independently of the removal of any other components; and
- to make both housing sections tiltable independently of each other while still only requiring one clamping and locking mechanism.

SUMMARY OF THE INVENTION

According to the invention the comminuting mill housing is divided vertically into two sections rather than horizontally so that each section is tiltable about its own hinging axis. The tilting hinges with their hinging axes are secured to a housing end wall or mounting shield, preferably a rear mounting shield. Each hinging axis extends at an angle to a plane that in turn extends horizontally through the horizontal rotational axis of a cutting rotor mounted for rotation in a front mounting shield and in the rear mounting shield. Thus, it is possible to tilt each housing section independently of the other housing section away from the rotor in an opening direction and toward the rotor in a closing direction. A clamping and locking device is connected to the housing sections at the housing end opposite to the mounting shield where the hinges are positioned. Preferably the clamping and locking device is positioned at the front end of the housing, while the hinges are positioned at the rear of the housing. The opposite arrangement is also possible.

The hinge axes are preferably oriented vertically, whereby they extend perpendicularly to the above mentioned horizontal plane through the rotor axis. However, an angular orientation of the hinges relative to the rotational axis of the cutting rotor, is also possible.

The construction according to the invention makes it possible to tilt each housing section in opposite directions even through 90° or more, whereby the housing sections are connected to the housing wall, preferably the rear wall only at the rear ends of the housing sections. As a result, the rotor as well as the screen or sieve are easily accessible from both sides even if the rotor and screen remain in their operational position. The same applies to the cleaning of the interior surfaces of the housing sections, because by tilting them outwardly they become easily accessible. The access is very good from both sides if the tilting or hinging axes extend vertically, whereby each of the housing sections can be tilted outwardly for an angle larger than 90°. Opening and closing the housing is especially simple because the clamping and locking mechanism is effective simultaneously on both housing sections, whereby in spite of the individual tilting of the housing sections, only one clamping and locking device is required to interlock the housing sections in their operating position. For this purpose, the clamping and locking device is divided and has one portion secured to one housing section and another portion secured to the other housing section so that one such device is sufficient. No other mounting or dismounting operations are required once each housing section has been tilted into the opened position.

Another advantage of the construction according to the invention is seen in that the entire mill is compact and it can be competitively priced with the added advantages mentioned above. Conventionally, the horizontal hinging axis extended along the entire length of the housing. According to the invention, each hinge is substantially shorter than the conventional hinge that extends along the entire housing length. The positioning of the hinges at the sides of the housing does not adversely increase the structural width of the mill.

Another advantage is seen in that the rotor shaft can be mounted in a cantilevered fashion in only one bearing positioned in the rear end wall or rear mounting shield, or it may be mounted in two bearings, one being positioned in each end wall or mounting shield. If a front end bearing is used, additional bracing for the front end bearing may be provided in the front end wall or front mounting shield. The bracing would extend radially relative to the longitudinal rotational axis of the cutting rotor and be tiltable together with the respective housing section.

According to another embodiment of the invention, the stator may be constructed independently of the tiltable housing sections, whereby the stator comprises a frame including two knife carriers rigidly interconnecting the front and rear mounting shields. The stator knives are mounted to the knife carriers. This construction of the stator does not have a housing function or only a limited housing function and thus it is easily accessible when the housing sections are opened. As a result, the stator and the rotor can be cleaned and maintained without any problems. By mounting the stationary or stator knives in a separate stator frame of the mill the advantage is obtained that the stator knives do not move with the housing sections as the housing sections are tilted. As a result, it is possible to precisely adjust the knife gap between the rotor knives and the stator knives without any danger of changing the knife gap by any subsequent motions that could tilt the housing sections into the open or closed position. As a result, the present cutting or comminuting mill does not require precision guiding mechanisms for movable parts nor for the tiltable housing sections while still assuring a precise knife gap.

BRIEF DESCRIPTION OF THE DRAWINGS

In order that the invention may be clearly understood, it will now be described, by way of example, with reference to the accompanying drawings, wherein.

Figure 1:
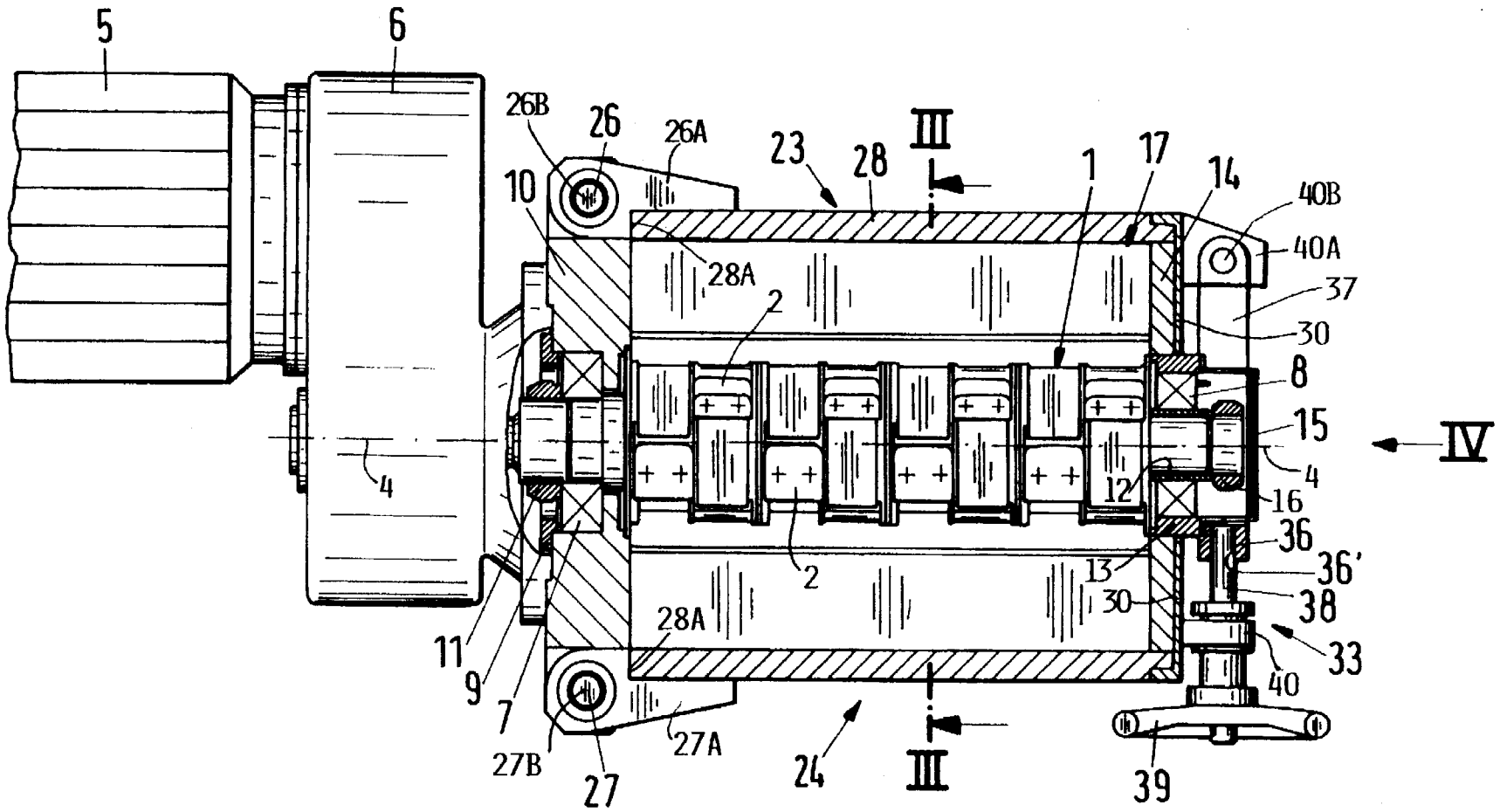
FIG. 1 shows the present cutting mill partially in section with the section plane extending in the rotational axis of the mill rotor which itself is not shown in section, whereby the tiltable housing sections are shown in their closed, operational position.

DETAILED DESCRIPTION OF PREFERRED EXAMPLE EMBODIMENTS AND OF THE BEST MODE OF THE INVENTION

Referring to FIGS. 1 to 4 in conjunction, the mill shown in these figures comprises a rotor 1 with rotor knives 2 releasably secured to the rotor, for example by screws shown symbolically by: +. The cutting rotor 1 comprises a rotor shaft 3 having a central rotational axis 4. The rotor is driven by a motor 5 preferably through a gear 6 flanged to a rear housing wall or mounting shield 10 by a flange 6A.

The rotor shaft 3 has a rear end mounted in a rear bearing 7 and a front end mounted in a front bearing 8. The rear bearing 7 is secured in the rear mounting shield 10, whereby the outer race of the bearing 7 is held axially in place by a ring 9 secured to the shield 10 and the inner race of the bearing 7 is held in place by a threaded ring 11 on the threaded rear end portion of the rotor shaft 3.

The front bearing 8 is positioned on a shaft sleeve 12 mounted in a bearing housing 13 which in turn is held in a bore of a front end mounting shield 14. A bearing cover 15 is secured to the bearing housing 13 and covers the front end of the shaft 3 including the front bearing 8. A position adjustable threaded ring or nut 16 is provided to restrain the bearing bushing 12 against axial movement.

An independent stator 17 comprising two stator sections 18 and 19 is mounted in the housing and carries two stationary or stator knives 20 and 21. The stator sections 18 and 19 are so positioned in the housing that the two stationary knives are positioned in parallel to the central rotational axis 4 of the rotor 1 for cooperation with the rotor knives 2. For this purpose, the knife carriers 18 and 19 extend opposite each other with horizontally oriented shoulders spaced so that the rotor 1 is positioned between the knife carriers. The knife carriers 18 and 19 in turn extend lengthwise between the mounting shields 10 and 14. In a preferred embodiment, the ends of the knife carriers 18 and 19 are rigidly secured to the mounting shields 10 and 14, thereby forming a stator frame. It is preferable that the stator knives 20 and 21 are exchangeably mounted in the respective knife carrier 18 and 19, for example by screws similar to the mounting screws of the rotor knives 2. These screws for mounting the stator knives 20, 21 preferably cooperate with elongated holes extending for example perpendicularly to the vertical plane 31 of the cutting mill for adjusting the position of the stator knives toward and away from the rotor knives the provide the required knife gap width.

A screen or sieve 22 having a semi-circular cross-section is mounted in the stator frame below the rotor 1. The longitudinal edges of the screen 22 extend in parallel to the rotor axis 4 and in parallel to and below the stationary knives 20 and 21. Preferably, the screen can be removed axially for cleaning or exchange.

The cutting mill according to the invention comprises two housing sections 23 and 24 each provided with a hinge bracket 26A and 27A respectively for hinges 26 and 27 that secure the respective housing section 23 and 24 to the rear mounting shield 10 so that the axes 26B and 27B of the hinges 26 and 27 extend along opposite sides of the rear mounting shield 10, and preferably in parallel to each other. These individual hinges enable the housing section 23, 24 to be tilted independently of one another as best seen in FIG. 2 and as indicated by the arrows 23A and 24A showing the opening and closing directions.

Figure 3:
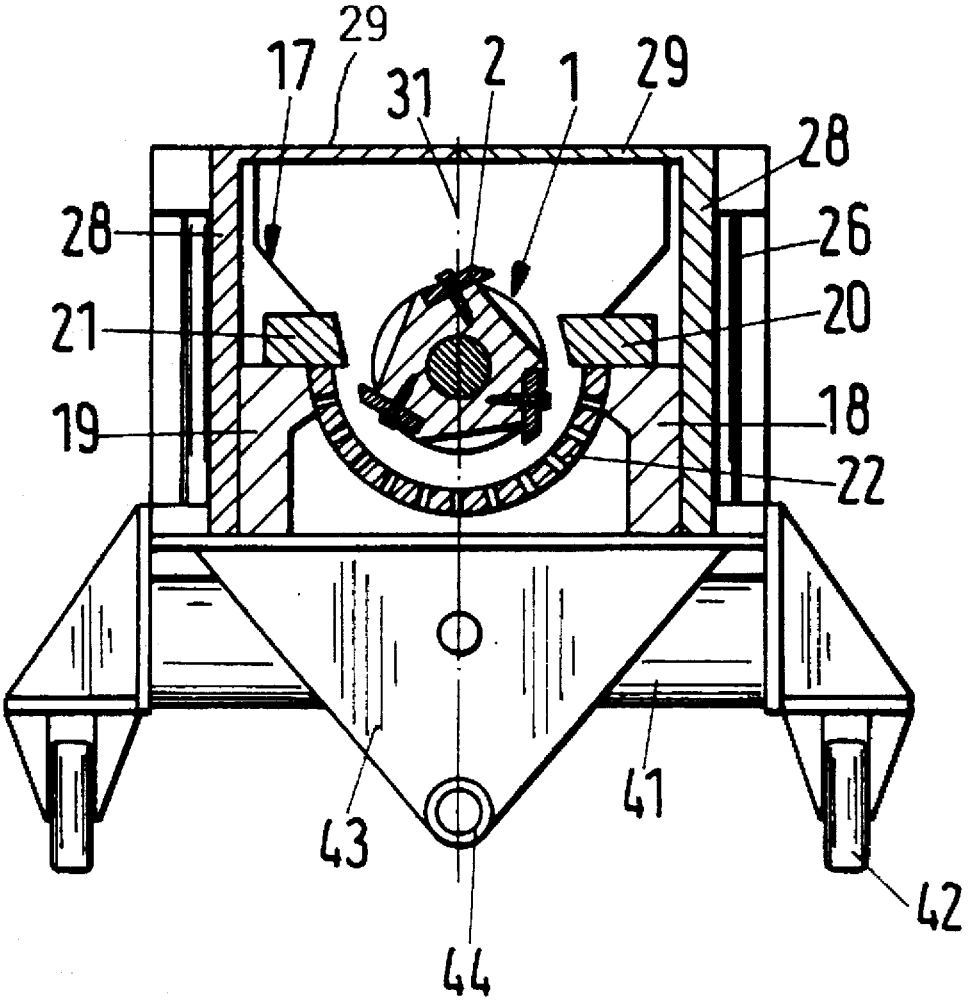
FIG. 3 is a sectional view along section line III—III in FIG. 1.

Each housing section 23, 24 comprises a side wall 28 carrying a top wall portion 29 extending at a right angle inwardly as best seen in FIG. 3. Each housing section further comprises a front cover portion 30 provided with an opening 32 to surround the bearing housing 13 in the front mounting shield 14 when the housing sections 23, 24 are in the closed position shown in FIG. 1. Both wall portions 29 and 30 extend at right angles relative to the plane of the respective housing section 28. The wall portions 29 and 30 are so dimensioned that they reach all the way to the center plane 31 in the closed position of the housing sections 23 and 24. A certain overlap may be provided along the edges of these wall portions to close the housing sufficiently for a cutting operation.

Referring to the closed operational position of the housing sections 23, 24 shown in FIG. 1, the two housing sections 23 and 24 are interlocked inwardly toward each other relative to the longitudinal axis 4 of the rotor 1 by a clamping and locking device 33, whereby the housing walls 28 are so dimensioned that they rest with their front wall portions 30 against the front mounting shield 14. Further, the rear edges 28A of the walls 28 are so positioned that they contact the rear mounting shield 10 to thereby completely enclose a cutting chamber inside the housing. The rear and front mounting shields 10 and 14 form part of a milling chamber enclosure, but are not tiltable.

Figure 2:
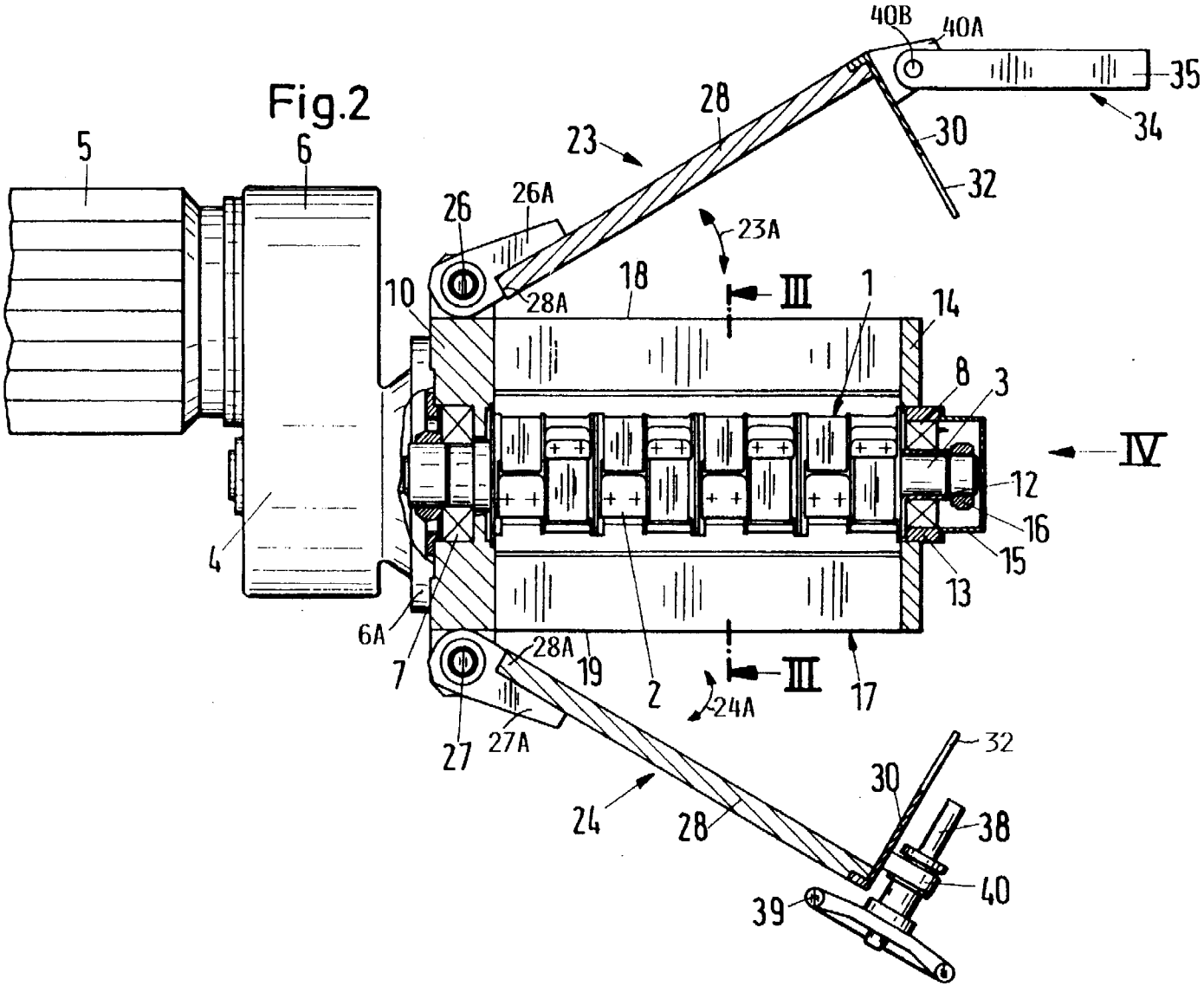
FIG. 2 is a view similar to that of FIG. 1, however showing the housing sections tilted into a partially open position.
Figure 4:
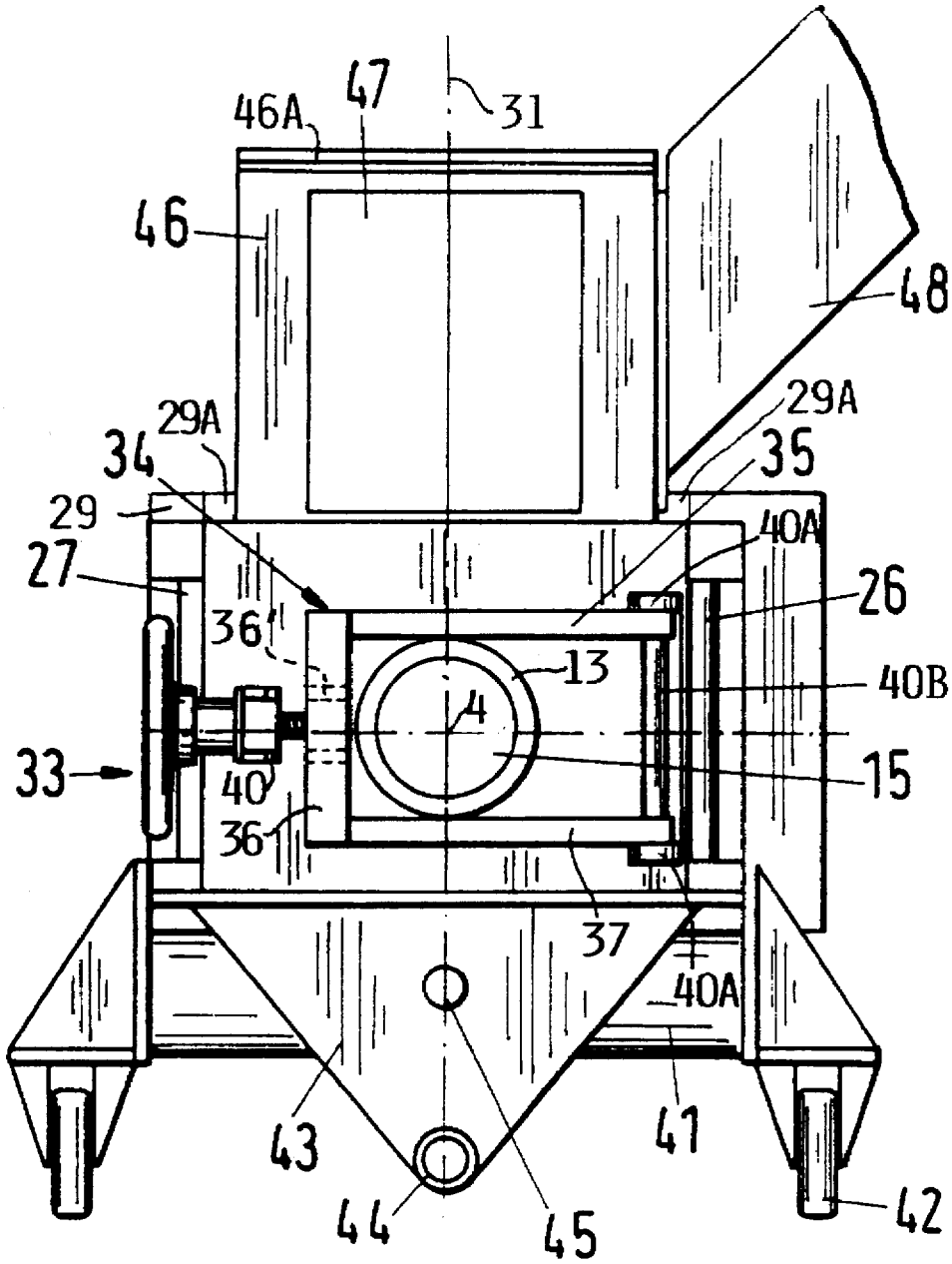
FIG. 4 is a view in the direction of the arrow IV in FIG. 1 to show the closed front end of the present cutting mill.

The clamping and locking device 33 comprises a substantially rectangular clamping frame 34 including an upper crossbar 35, a vertical bar 36, and a lower crossbar 37 rigidly interconnected with each other and with a hinging pin 40B mounted in hinging brackets 40A which in turn are secured to the respective front wall portion 30 of the tiltable housing sections as best seen in FIGS. 1 and 2. The clamping frame 34 is so dimensioned that it reaches around the bearing cover 15 and bearing mounting ring 13 as best seen in FIG. 4. The clamping device 33 includes a locking spindle 38 which is rotatably mounted in a mounting block 40 rigidly secured to the front cover wall portion 30 of one of the housing sections, for example 24. The threaded spindle 38 is rotatable in the mounting block 40 preferably by a manually operable wheel 39. The mounting block 40 permits rotation of the spindle 38 but only a limited axial spindle play just sufficient for introducing the free spindle end into a threaded hole 36' in the vertical bar 36 of the clamping frame 34.

When the housing sections 23 and 24 are in the closed position the clamping frame 34 assumes the position shown in FIG. 4, whereby the threaded spindle 38 engages with its free end the threaded hole 36' in the vertical bar 36. As a result, rotation of the spindle 38 will pull the two housing sections 23, 24 together and hold these sections in the closed operational position.

The above components of the present cutting mill are mounted on a base 41 shown in FIGS. 3 and 4. The base 41 is preferably supported on wheels 42 and carries a trough 43 having a funnel-shaped cross-section. In the operational position the trough 43 is arranged below the screen 22 for collecting the comminuted material passing through the screen 22. The trough 43 is provided with a suction port 44 shown in FIGS. 3 and 4 for the removal of comminuted material. A further opening 45 preferably provides a filling level indicator in the trough 43.

Referring further to FIG. 4, the present cutting mill is provided with a filler housing 46 provided with a viewing window 47 and a dust cover 46A as well as a filler hopper 48. These components are rigidly mounted on the front mounting shield 14. However, these components are positioned at an elevation in which they do not interfere with the accessibility to the rotor 1, to the stator knives 20 and 21, and as to the screen 22 when the housing sections 23 and 24 are in the tilted out position of FIG. 2. Similarly, the low positioned collecting trough 43 also does not interfere with the above described easy accessibility due to its low position. The top wall portions 29 of the housing sections 23, 24 are provided with cut-outs 29A to accommodate the filler housing 46.

The filler housing 46 has been illustrated to be connected to the front mounting shield 14. However, it is also possible to connect or mount the filler housing 46 with one of the housing sections 23 or 24 so that the filler housing with its hopper 48 would also be tiltable into an out of the way position.

Although the invention has been described with reference to specific example embodiments, it will be appreciated that it is intended to cover all modifications and equivalents within the scope of the appended claims.

What is claimed is:

1. An apparatus for comminuting waste materials, comprising a housing, a rear bearing shield (10), a front bearing shield (14), a knife rotor (1) rotatably mounted in said front and rear bearing shields, at least one rotor knife (2) carried by said knife rotor (1) for rotation about a rotational rotor axis (4), said housing comprising two housing sections (23, 24) matching each other for forming said housing in a closed position of said housing sections (23, 24), each housing section comprising a first hinge (26, 27) hingeably securing the respective housing section to one of said rear and front bearing shields, each first hinge (26, 27) comprising a first hinging axis (26A, 27A) extending crosswise to said rotational rotor axis (4) so that said housing sections (23, 24) are tiltable in opposite directions away from each other to open said housing and toward each other to close said housing, said apparatus further comprising a clamping and locking device (33) including a clamping frame (34) and a locking member (38), a second hinge (40B) hingeably securing said clamping frame (34) to one of said housing sections (23 or 24) near one of said front and rear bearing shields (14, 10), said locking member (38) being secured to the respective other housing section (24 or 23) of said housing sections (23, 24) for cooperation with said clamping frame to lock said housing sections (23, 24) to each other, and at least one stator knife (20, 21) positioned in said housing for cooperating with said rotor knife (2).

2. The apparatus of claim 1, wherein said housing comprises a central plane (31) longitudinally and vertically passing through said central rotational rotor axis (4), said central plane dividing said housing into said two housing sections (23, 24), said first hinging axes (26A, 27A) extending vertically, so that said housing sections (23, 24) are tiltable laterally toward and away from said central plane (31).

3. The apparatus of claim 1, further comprising a rear bearing (7) mounting one end of said knife rotor (1) in said rear bearing shield (10), a front bearing (8) mounting the other end of said knife rotor (1) in said front bearing shield (14), and mountings (26A, 27A) securing said first hinges (26, 27) to said rear bearing shield (10) and to said housing sections (23, 24).

4. The apparatus of claim 1, further comprising at least one stator knife carrier (18, 19) for said at least one stator knife, said knife carrier extending in said housing in parallel to said rotational rotor axis (4) and carrying said at least one stator knife, and wherein one end of said stator knife carrier is mounted to said rear bearing shield (10).

5. The apparatus of claim 1, comprising two stator knife carriers (18, 19) positioned in said housing diametrically opposite each other for cooperation with said at least one rotor knife, said two stator knife carriers (18, 19) being connected to said rear bearing shield (10) and to said front bearing shield (14) to form a stator frame in which said knife rotor (1) is rotatable.

6. The apparatus of claim 5, wherein said first hinges (26, 27) are so connected to said rear bearing shield (10) and to said housing sections, that said housing sections (23, 24) rest against respective backsides of said two knife carriers in a housing closed operating position of said housing sections (23, 24).

7. The apparatus of claim 5, further comprising a semi-circular screen (22) mounted in said housing to extend circumferentially around said rotor (1) from one of said two stator knife carriers (18, 19) to the other.

8. The apparatus of claim 1, wherein each of said two housing sections (23, 24) comprises a flat wall portion (28), said first hinges having hinging axes extending in parallel to said flat wall portion (28).

9. The apparatus of claim 8, wherein each of said two housing sections (23, 24) comprises a cover wall portion (29) extending at an angle from the respective flat wall portion (28) toward the respective other cover wall portion (29) in the closed position of said housing sections (23, 24).

10. The apparatus of claim 8, wherein each of said two housing sections (23, 24) comprises a front end wall portion (30) extending at a right angle from the respective flat wall portion (28) and radially inwardly in the closed position of said housing sections (23, 24).

11. The apparatus of claim 1, wherein said second hinge (40A, 40B) secures said clamping frame (35, 36, 37) to said one housing section (23), said clamping frame comprising a vertical bar (36) with a threaded hole (36') therein, said locking member comprising a threaded spindle (38) and a mounting (40) rotatably securing said threaded spindle (38) to said other housing section (24) in a position for said threaded spindle (38) to engage said threaded hole (36') for locking said housing sections (23, 24) to each other by rotating said spindle (38).

12. The apparatus of claim 11, further comprising a manually operated member (39) secured to said threaded spindle (38) for opening and closing said housing sections (23, 24).

13. The apparatus of claim 11, wherein said clamping frame (35, 36, 37) is so positioned that it extends around a front end of a rotor shaft rotatably mounted in said front bearing shield.

14. The apparatus of claim 11, comprising a front bearing (7) mounting said knife rotor in said front bearing shield (14) and a cover (15) for said front bearing, said clamping frame being so positioned that it extends around said front bearing cover (15).

15. The apparatus of claim 1, further comprising a drive (5, 6) for rotating said knife rotor, said drive being operatively connected to one end of said knife rotor.

16. The apparatus of claim 15, wherein said drive is mounted to said rear bearing shield.

17. The apparatus of claim 1, wherein said first hinges (26, 27) are hinged to said rear mounting shield, and said clamping and locking device is mounted to said housing sections (23, 24) at a front end (30) thereof.

* * * * *